US006953098B2

(12) United States Patent
Kriesels et al.

(10) Patent No.: US 6,953,098 B2
(45) Date of Patent: Oct. 11, 2005

(54) HYDRAULIC DRILL STRING ACCUMULATOR

(75) Inventors: Petrus Cornelis Kriesels, Assen (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 159 days.

(21) Appl. No.: 10/432,700

(22) PCT Filed: Nov. 27, 2001

(86) PCT No.: PCT/EP01/14138

§ 371 (c)(1),
(2), (4) Date: Jul. 22, 2003

(87) PCT Pub. No.: WO02/42647

PCT Pub. Date: May 30, 2002

(65) Prior Publication Data

US 2004/0026130 A1 Feb. 12, 2004

(30) Foreign Application Priority Data

Nov. 27, 2000 (EP) ..... 00204199

(51) Int. Cl.[7] ..... E21B 1/24
(52) U.S. Cl. ..... 175/297; 92/175
(58) Field of Search ..... 175/296, 297, 175/417; 92/175, 181 R

(56) References Cited

U.S. PATENT DOCUMENTS 4,828,048 A 5/1989 Mayer et al.
5,402,854 A 4/1995 Kimberlin et al.
5,794,516 A * 8/1998 Wolfer et al. ..... 92/155

FOREIGN PATENT DOCUMENTS

RU 2100558 12/1997 ..... E21B 4/14

* cited by examiner

*Primary Examiner*—William Neuder

(57) ABSTRACT

A hydraulic accumulator for use in a drill string having a fluid passage for supply of fluid to a hydraulic drill string tool is provided. The accumulator comprises a body provided with connecting means for connecting the accumulator to the drill string and an expansion chamber in fluid communication the fluid passage when the accumulator is connected to the drill string by the connecting means. The expansion chamber is expandable between a first volume and a second volume which is larger than the first volume. Further, the expansion chamber is provided with means for moving the expansion chamber from the first to the second volume upon a fluid pressure increase in the fluid passage and for moving the expansion chamber from the second to the first volume upon a pressure decrease in the fluid passage.

11 Claims, 2 Drawing Sheets

HYDRAULIC DRILL STRING ACCUMULATOR

PRIORITY CLAIM

The present application claims priority on European Patent Application 00204199.4, filed on Nov. 27, 2000.

FIELD OF THE INVENTION

The present invention relates to a hydraulic accumulator for use in a drill string having a fluid passage for supply of fluid to a hydraulic drill string tool.

BACKGROUND OF THE INVENTION

Subterranean drilling typically involves a drill string having a bottom hole assembly provided with tools configured to perform a variety of functions. The tools are generally powered by drilling fluid pumped through the drill string. Some fluid driven drill string tools require a fluctuating amount of fluid over time. An example of such tool is a percussion hammer applied to drive a percussion drill bit. During part of the operational cycle of such percussion hammer the demand for fluid is higher than the time-average demand, while during another part of the cycle the demand is lower than the time-average demand. As a result thereof, the pressure across the tool also has a strong variation. During the part of the cycle of higher fluid demand the pressure across the tool is lower than the time-average, and during the part of the cycle of lower fluid demand the pressure across the tool is higher than the time-average. This variation of pressure is generally referred to as water hammer. It causes a reduction of drilling efficiency and potentially interferes with other drill string tools such as pressure-pulse based communication system.

SUMMARY OF THE INVENTION

It is an object of the invention to provide a device which alleviates the pressure variations and which overcomes the aforementioned problems.

In accordance with the invention there is provided a hydraulic accumulator for use in a drill string having a fluid passage for supply of fluid to a hydraulic drill string tool, the accumulator comprising a body provided with connecting means for connecting the accumulator to the drill string and an expansion chamber in fluid communication the fluid passage when the accumulator is connected to the drill string by the connecting means, the expansion chamber being expandable between a first volume and a second volume which is larger than the first volume, and wherein the expansion chamber is provided with means for moving the expansion chamber from the first to the second volume upon a fluid pressure increase in the fluid passage and for moving the expansion chamber from the second to the first volume upon a pressure decrease in the fluid passage.

The volume increase of the expansion chamber compensates for the fluid pressure increase caused by the drill string tool, and the volume decrease of the expansion chamber compensates for the fluid pressure decrease caused by the tool. It is thereby achieved that a substantially constant fluid pressure is maintained in the drill string.

Suitably the expansion chamber is movable between said volumes by virtue of a cylinder/piston arrangement wherein the piston is movable in the cylinder between a first position in which the chamber has the first volume and a second position in which the chamber has the second volume.

In a preferred embodiment the accumulator is connected to the drill string by the connecting means, and wherein said hydraulic drill string tool is a percussion hammer arranged to drive percussion drill bit of the drill string. In order to allow operation of the accumulator/percussion hammer assembly to be independent from the type of drill bit used, it is preferred that the percussion hammer is arranged to receive a first stream of fluid from the expansion chamber, and wherein the drill bit is arranged to receive a second stream of fluid from the fluid passage, the first stream being separate from the second stream.

BRIEF DESCRIPTION OF THE DRAWINGS

The invention will be described hereinafter in more detail and by way of example, with reference to the accompanying drawings in which the examples should not be construed to limit the scope of the invention.

DETAILED DESCRIPTION OF THE PREFERRED EMBODIMENT

Figure 1:
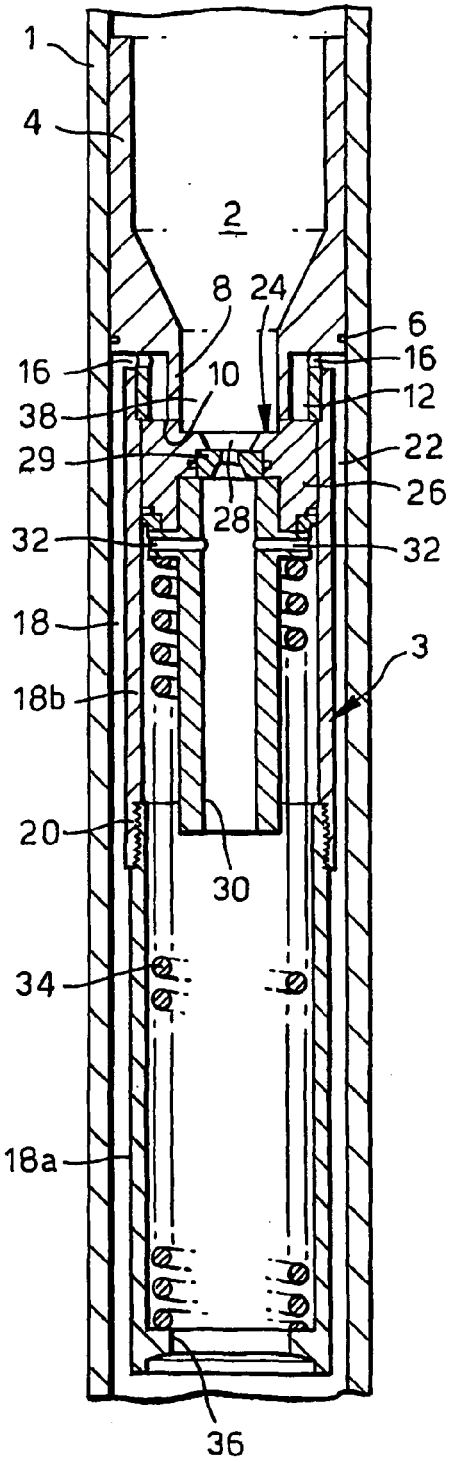
FIG. 1 schematically shows an embodiment of the accumulator of the invention in a first mode thereof.

Referring to FIG. 1 there is shown a drill string 1 having a fluid passage 2 into which the hydraulic accumulator 3 of the invention is arranged. The drill string 1 extends into a borehole (not shown) and has a bottom hole assembly (not shown) including a hydraulic percussion hammer arranged to drive a drill bit. The percussion hammer operates on the basis of a reciprocating piston in a cylinder, whereby the hydraulically activated movement of the piston involves a time varying fluid supply through the drill string to the hammer. The hydraulic percussion hammer is designed to become only active when the flow rate of the fluid exceeds a certain threshold flow rate in order to allow circulation of drilling fluid through the borehole without activation of the hammer, for example to clean the borehole from drill cuttings.

The accumulator 3 includes a tubular body 4 of outer diameter substantially equal to the inner diameter of the drill string 1, which body 4 is fixedly connected to the inner surface of the drill string 1 and sealed thereto by an annular seal 6. The inner tube 4 is provided with a lower end portion of reduced internal and external diameter, which portion forms a tubular inlet 8 for an expansion chamber described hereinafter. The tubular inlet 8 has a lower end surface 10 in which an annular recess 12 is arranged, which recess 12 is in fluid communication with the exterior of the inlet 8 by means of openings 16 provided in the wall of the inlet 8.

A tubular cylinder 18, formed of parts 18*a*, 18*b* interconnected by connector 20 and having an inner diameter substantially equal to the outer diameter of the inlet 8, is at its upper end connected to the inlet 8 by means of a screw connection (not shown). The outer diameter of the cylinder 18 is smaller than the inner diameter of the drill string so that an annular space 22 is formed between the cylinder 20 and the drill string 1. The annular space 22 provides fluid communication between the annular recess 12 (via openings 16) and the fluid inlet of the percussion hammer.

A piston 24 is slideably and sealingly arranged in the cylinder 20, which piston includes a piston body 26 capable of sealingly engaging the lower end of the inlet 8 and being provided with a through-opening 28. An annular flow restrictor 29 is arranged in the through-opening 28. The piston body 26 is provided with a tubular extension 30 aligned with the through-opening and extending below the piston body 26. The tubular extension 30 provides fluid communication between the portion of the fluid passage 2 upstream the accumulator 3 (via through-opening 28) and the fluid nozzles of the drill bit (not shown). The extension 30 is provided with two small transverse channels 32 which provide fluid communication between the interior and the exterior of the extension 30. A helical compression spring 34 is arranged in the cylinder 20, between the piston 24 and an internal annular shoulder 36 provided at the lower end of the cylinder. The spring 34 urges the piston 24 in upward direction so that, in the absence of a restraining force, the piston 24 in a first position thereof is biased against the inlet 8 whereby the piston body 26 sealingly engages the lower end of the inlet 8. An expansion chamber 38 is defined between the upper end of the piston body 26, the inner surface of the cylinder 18, and the lower end part of the inlet 8. With the piston in the first position (FIG. 1) the expansion chamber has a first, relatively small, volume.

Figure 2:
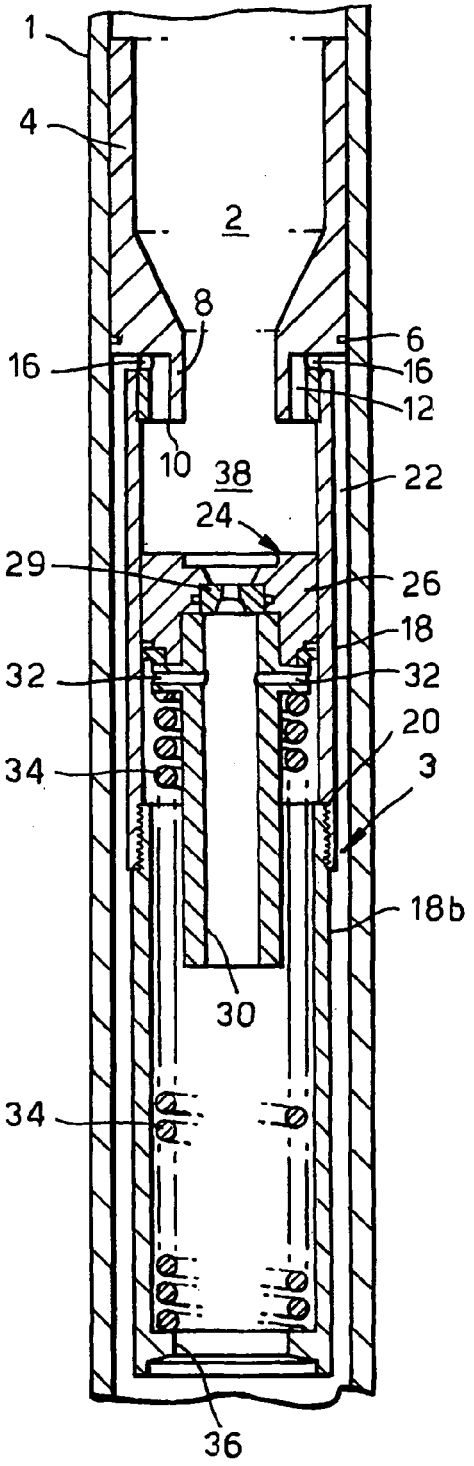
FIG. 2 schematically shows the accumulator of FIG. 1 in a second mode thereof.

Referring to FIG. 2 there is shown the assembly of FIG. 1 wherein the piston 24 is axially displaced from the inlet 8. This position of the piston 24 is referred to as the second position, and the corresponding volume of the expansion chamber 38 is referred to as the second volume which is larger than the first volume.

The characteristics of the spring 34 are selected such that the piston 24 remains in the first position as long as the flow rate of fluid pumped through the drill string 1 is below the threshold flow rate referred to above.

Figure 3:
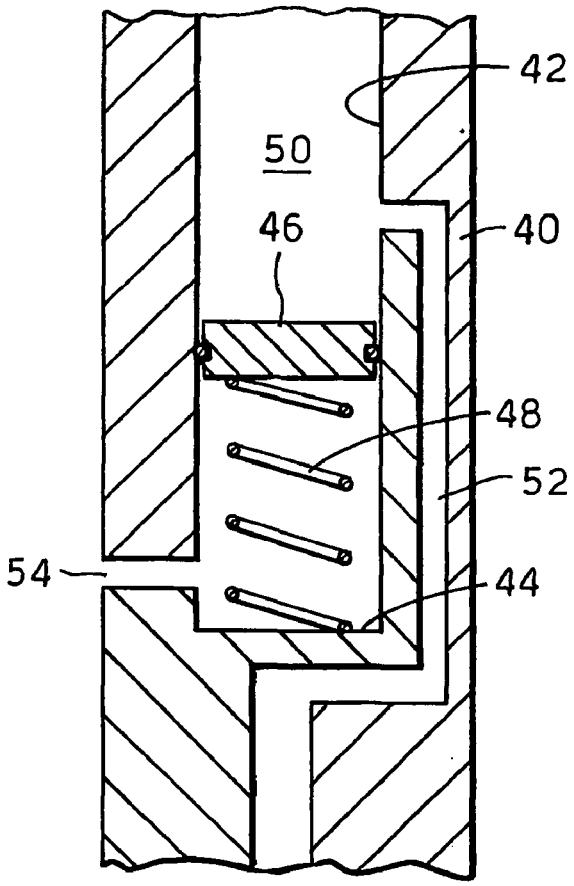
FIG. 3 schematically shows a first alternative embodiment of the accumulator of the invention.

The first alternative accumulator shown in FIG. 3 includes a tubular body 40 fixedly and sealingly arranged in the fluid passage of a drill string (not shown). Similarly to the embodiment of FIGS. 1, 2 the drill string has a bottom hole assembly (not shown) including a percussion drill bit driven by a hydraulic percussion hammer (not shown). The body 40 is provided with a cylindrical bore 42 is formed having a closed lower end 44 and an open upper end in fluid communication with an upper portion of the fluid passage of the drill string. A piston 46 is slideably arranged in the bore 42, which piston is biased upwardly by a helical compression spring 48 arranged between the piston 46 and the lower end 44 of the bore. An expansion chamber 50 is defined in the bore 42, between the piston 46 and the upper end of the bore 42. A fluid passage 52 is provided in the body 40, which provides fluid communication between the expansion chamber 50 and a lower portion of the fluid passage of the drill string. Further, the body 40 is provided with a small bore 54 providing fluid communication between the portion of the bore 42 below the piston 46 and the exterior of the drill string.

Figure 4:
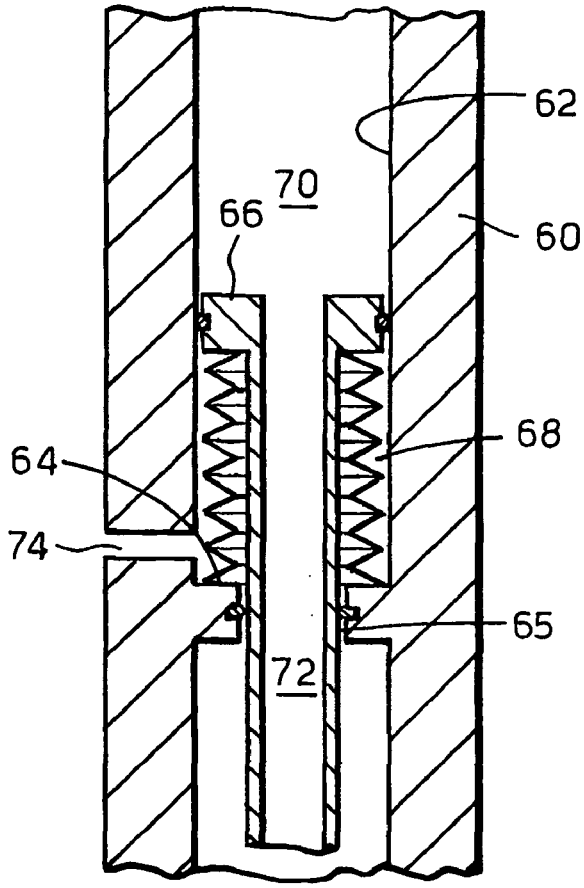
FIG. 4 schematically shows a second alternative embodiment of the accumulator of the invention.

The second alternative accumulator shown in FIG. 4 includes a tubular body 60 fixedly and sealingly arranged in the fluid passage of a drill string (not shown). Similarly to the embodiment of FIGS. 1, 2, 3 the drill string has a bottom hole assembly (not shown) including a percussion drill bit driven by a hydraulic percussion hammer (not shown). The body 60 is provided with a cylindrical bore 62 is formed having a lower end 64 provided with a through-opening 65 and an open upper end in fluid communication with an upper portion of the fluid passage of the drill string. A piston 66 is slideably arranged in the bore 62, which piston is biased upwardly by a helical compression spring 68 arranged between the piston 66 and the lower end 64 of the bore. An expansion chamber 70 is defined in the bore 62, between the piston 66 and the upper end of the bore 62. The piston 66 is provided with a fluid conduit 72 which slideably extends through the through-opening 65 of the lower end 64 of the bore 62. The conduit 72 provides fluid communication between the expansion chamber 66 and a lower portion of the fluid passage of the drill string. Further, the body 60 is provided with a small bore 74 providing fluid communication between the portion of the bore 62 below the piston 66 and the exterior of the drill string.

During normal use of the embodiment of FIGS. 1, 2 hydraulic fluid in the form of drilling fluid is pumped through the drill string to the bottom hole assembly. As long as the flow rate of the fluid is below the threshold flow rate the piston 24 remains in the first position and the fluid flows from the fluid passage 2 of the drill string 2 into the accumulator 3 where it passes via the through-opening 28 and the extension 30 to the fluid nozzles of the drill bit. With the piston in the first position, the hydraulic area of the piston (i.e. the area against which the fluid flows) is equal to the inner cross-sectional area of the inlet 8.

When the fluid flow rate in the drill string exceeds the threshold flow rate, the fluid initially pushes the piston 24 slightly downwardly against the force of the spring 34. Upon the piston loosing contact with the inlet 8, the hydraulic area of the piston suddenly increases to the inner cross-sectional area of the cylinder 18. As a result the piston 24 undergoes a step-wise downward displacement to the second position whereby the spring 34 becomes significantly compressed. During the sudden movement of the piston 24 the transverse channels 32 allow for fluid pressure balancing between the interior and exterior of the piston 24.

With the piston 24 in the second position, part of the fluid flows from the fluid passage 2 into the expansion chamber 38 and from there via the openings 16 and the annular space 22 to fluid inlet of the percussion hammer. Another part of the fluid flows via the through-opening 28 and the extension 30 to the fluid nozzles of the drill bit.

The time varying fluid supply consumed by the percussion hammer causes pressure fluctuations in the fluid upstream the hammer. When the fluid pressure upstream the hammer increases during an upward stroke of the piston of the hammer, the pressure in the expansion chamber 38 also increases thereby causing the volume of the chamber 38 to increase by virtue of downward movement of the piston 24 against the force of spring 34. Since the fluid supply to the drill string remains substantially constant in time, the effect of the increasing volume of the chamber 34 is a decrease of the fluid pressure in the drill string upstream the accumulator 3. The decrease of fluid pressure compensates for the increase of pressure caused by the upward stroke of the hammer.

Conversely, when the fluid pressure upstream the hammer decreases during a downward stroke of the piston of the hammer, the pressure in the expansion chamber 38 also decreases thereby causing the volume of the chamber 38 to decrease by virtue of upward movement of the piston by the force of spring 34. The decreasing volume of the chamber 34 causes an increase of the fluid pressure upstream the accumulator 3 thereby compensating for the decrease of the fluid caused by the downward stroke of the hammer.

It is thus achieved that the fluid pressure upstream the accumulator remains substantially constant irrespective of the time varying fluid demand of the hammer.

Normal operation of the first alternative embodiment (FIG. 3) is substantially similar to normal operation of the embodiments of FIGS. 1, 2. One difference is that the piston 46 has no through-opening, and that therefore all fluid flows via the fluid passage 52 to the hydraulic percussion hammer. When the fluid pressure upstream the hammer increases during an upward stroke of the piston of the hammer, the pressure in the expansion chamber 50 also increases thereby causing the volume of the chamber 50 to increase by virtue of downward movement of the piston 46 against the force of spring 48. Since the fluid supply to the drill string remains substantially constant in time, the effect of the increasing volume of the chamber 50 is a decrease of the fluid pressure in the drill string upstream the accumulator. The decrease of fluid pressure compensates for the increase of pressure caused by the upward stroke of the hammer.

Conversely, when the fluid pressure upstream the hammer decreases during a downward stroke of the piston of the hammer, the pressure in the expansion chamber 50 also decreases thereby causing the volume of the chamber 50 to decrease by virtue of upward movement of the piston by the force of spring 48. The decreasing volume of the chamber 50 causes an increase of the fluid pressure upstream the accumulator thereby compensating for the decrease of the fluid caused by the downward stroke of the hammer.

Normal operation of the second alternative embodiment (FIG. 4) is similar to normal operation of the first embodiment, the difference being that all fluid now flows via fluid conduit 72 to the hydraulic percussion hammer instead of via the fluid passage 52 of the first alternative embodiment. Furthermore, the fluid conduit 72 slideably moves through the opening 65 during up- and downward movement of the piston 66.

Instead of use of the accumulator of the invention for compensation of pressure variations of a percussion hammer, the accumulator can be used to compensate for pressure variations caused by any other drill string tool.

What is claimed is:

1. A hydraulic accumulator for use in a drill string having a fluid passageway for a supply of fluid at a selected pressure to a hydraulic drill string tool to maintain the selected pressure in the drill string, the accumulator comprising:

(a) a body provided with connecting means for connecting the accumulator to the drill string; and (b) an expansion chamber in fluid communication with the drill string and having a fluid passageway therethrough, the expansion chamber being expandable between a first and a second position, wherein the expansion chamber volume is greater in the second position, and wherein the expansion chamber is provided with means for moving the expansion chamber from the first to the second volume upon a fluid pressure increase in the fluid passageway and for moving the expansion chamber from the second to the first volume upon a pressure decrease in the fluid passageway, wherein the expansion chamber further provides for a first fluid outlet from the expansion chamber to the hydraulic drill string tool as the expansion chamber moves to its second position, the first fluid outlet being closed when the expansion chamber is in its first position, and wherein the expansion chamber has a second fluid outlet in fluid communication with a part of the fluid passage down stream the accumulator when the accumulator is connected to the drill string by the connecting means.

2. The accumulator of claim 1, wherein the expansion chamber is movable between said volumes by virtue of a cylinder/piston arrangement wherein the piston is movable in the cylinder between the first position in which the chamber has a first volume and the second position in which the chamber has a second volume.

3. The accumulator of claim 2, wherein the cylinder/piston arrangement is provided with a spring biasing the piston from the second to the first position.

4. The accumulator of claim 2, wherein the hydraulic area of the piston is smaller when the piston is in the first position than in the second position.

5. The accumulator of claim 4, wherein the expansion chamber is provided with an inlet in fluid communication with the fluid passage, the inlet having an annular end against which the piston in the first position thereof is biased, the annular end being of a smaller diameter than the piston diameter.

6. The accumulator of claim 2, wherein the cylinder is arranged substantially concentrically in the drill string with an annular space between the cylinder and the drill string when the accumulator is connected to the drill string by the connecting means, and wherein the first outlet opening is in fluid communication with said annular space.

7. The accumulator of claim 1, wherein fluid communication is enabled via the second outlet opening when the expansion chamber is moved in the first volume.

8. The accumulator of claim 7, wherein the second outlet opening is provided in the piston.

9. The accumulator of claim 1, wherein the accumulator is connected to the drill string by the connecting means, and wherein said hydraulic drill string tool is a percussion hammer arranged to drive percussion drill bit of the drill string.

10. The accumulator of claim 9, wherein the percussion hammer is arranged to receive a first stream of fluid from the expansion chamber, and wherein the drill bit is arranged to receive a second stream of fluid from the fluid passage, the first stream being separate from the second stream.

11. The accumulator of claim 10, wherein the percussion hammer is arranged to receive the first stream of fluid via the first outlet and the drill bit is arranged to receive the second stream of fluid via the second outlet.

* * * * *